US006504480B1

(12) United States Patent
Magnuson et al.

(10) Patent No.: US 6,504,480 B1
(45) Date of Patent: Jan. 7, 2003

(54) ELECTRONIC DEVICE SECURITY

(75) Inventors: David Magnuson, Boise, ID (US); David Luman, Meridian, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/925,264

(22) Filed: Aug. 9, 2001

(51) Int. Cl.[7] ..... G08B 13/14

(52) U.S. Cl. ..... 340/571; 340/686.1; 340/5.1; 340/5.21

(58) Field of Search ..... 340/571, 540, 340/568.1, 686.6, 5.1, 5.2, 5.21, 5.22, 5.23, 825.44; 455/421, 67.1

(56) References Cited

U.S. PATENT DOCUMENTS 5,757,271 A * 5/1998 Andrews ..... 340/568
5,801,627 A * 9/1998 Hartung ..... 340/568.1
6,011,471 A * 1/2000 Huang ..... 340/568.1
6,151,493 A * 11/2000 Sasakura et al. ..... 455/421
6,166,635 A * 12/2000 Huang ..... 340/571
6,265,974 B1 * 7/2001 D'Angelo et al. ..... 340/568.1

* cited by examiner

*Primary Examiner*—Toan Pham

(57) ABSTRACT

A preferred embodiment of the present invention provides an electronic proximal security system comprising a master device including a first transmitter for communicating at least one device code, and a code processor. The system also comprises at least one slave device including a receiver for communicating the at least one device code, a code translator, and a slave controller for limiting access to functionality of the slave device responsive to the at least one device code transmitted from the master device.

14 Claims, 3 Drawing Sheets

ELECTRONIC DEVICE SECURITY

TECHNICAL FIELD

The invention relates in general to security systems and, in particular, to electronic security systems providing proximal access signals to surrounding electronic devices.

BACKGROUND

In today's world, electronics and electronic devices are rapidly multiplying and entrenching themselves into our everyday lives. Mobile telephones, pagers, personal data assistants (PDAs), laptop computers, and the like are each indispensable in their own way to any number of different people. With the increase in availability and demand for such electronics, theft of such devices is generally growing at an alarming rate. Furthermore, because devices such as PDAs and laptops do not require establishing a "phone number" or specific address for use, such as with a pager, thieves are very likely to consider stealing these items first.

Moreover, theft of laptops and PDAs may also be driven by the desire for industrial espionage or to simply steal intellectual property of one's competitors. Because such devices also typically do not require passwords or keys to operate, they become ready targets for industrial spies.

Mobile phones and pagers offer relatively more resistance to theft because each must be programmed by a provider into a particular wireless technology network. Thus, it would be much easier for one service provider to discover stolen phones and pagers that were originally programmed for the same or competing service provider. However, as criminals become more technically savvy, it is generally becoming just as easy to "clean" a mobile phone or pager for use.

Certain inventions have been implemented to safeguard such electronic devices. Physical alarm units have been built to attach to laptops. Such devices activate an alarm noise when the laptop is disturbed or lifted from its position. This device may provide some deterrence to theft, but will not prevent a thief from using the laptop, if he or she is capable of removing the alarm.

Laptops, PDAs, and mobile communication devices have also been modified to work only if an initial password is entered. Such password protections systems provide a sizeable level of security for the devices, but may also effectively secure the device from the true owner if the owner ever forgets the password. Moreover, if the owner writes the password down somewhere, thieves could steal the password as well as the electronic device to gain access to the functionality of the device.

Password protection systems also limit the ability of the owner to lend out his or her equipment. If a parent-owner of a mobile phone desired to lend his or her phone to one of his or her children, the children would have unlimited access to the phone's functions if the parent-owner gives them his or her password. Such an attribute does not allow the owner to provide variable limitations on access to the functionality of the device.

Still further security systems take advantage of a physical key device. The key system has been used in security systems dating back to the Middle Ages and possibly earlier. The ancient system of a key unlocking a castle-gate, is typically applied in a modem sense with an electronic device. The owner must use the physical key to either manipulate tumblers to activate or de-activate access or may use an electronic connection to activate or de-activate access. However, with the physical key system, the key is still usually vulnerable to theft just as much as the device itself. Furthermore, if the user forgets to bring the key, the device is equally as useless.

Automobiles have also begun to use electronic security measures for protecting cars against theft. Some automobile manufacturer's have begun installing microchips and microcircuits into the keys of some automobiles. Unless the key with the microcontroller is inserted into the ignition, the engine is disabled. While this system protects the automobiles against hot-wiring or from being started without a key, the car will be just as easily stolen if a thief steals the key with the embedded microcircuit.

SUMMARY OF THE INVENTION

The present invention is directed to a system and method for providing proximal security to an electronic device. The preferred embodiment of the present invention provides an electronic proximal security system comprising a master device including a first transmitter for communicating at least one device code, and a code processor. The system also comprises at least one slave device including a first receiver for communicating the at least one device code, a code translator, and a slave controller for limiting access to functionality of the slave device responsive to the at least one device code transmitted from the master device.

DETAILED DESCRIPTION

Figure 1A:
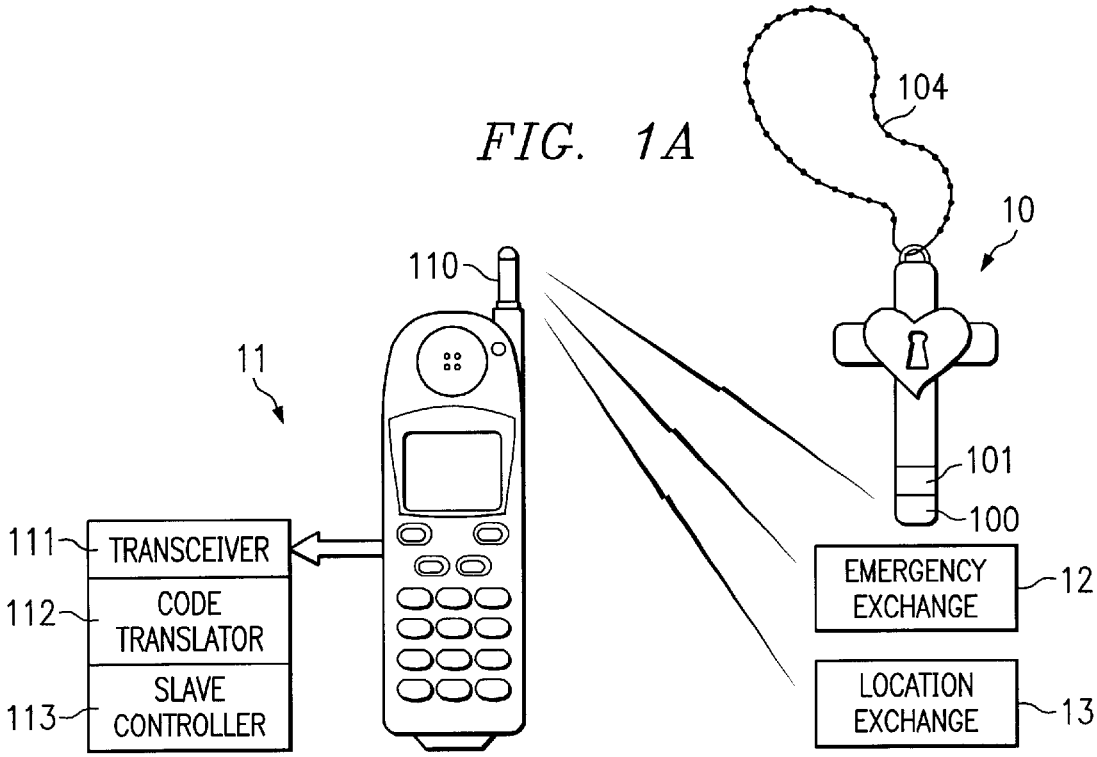
FIG. 1A is a perspective view illustrating a preferred embodiment of the present invention implemented with the master device as a piece of jewelry.

FIG. 1A illustrates a preferred embodiment of the present invention configured with a single master or key device and a single slave device. Master 10 is illustrated as a piece of jewelry in the shape of a cross. While Master 10 comprises standard jewelry elements, such as necklace 104, it also comprises master transceiver 100 and code processor 101. Master 10 may alternatively use a transmitter instead of master transceiver 100 Slave phone 11 is illustrated as a mobile phone having antenna 110 leading to slave transceiver 111. Slave phone 11 may alternatively use a receiver instead of transceiver 111. Slave phone 11 also preferably comprises code translator 112 and slave controller 113.

It should be noted that master 10 may preferably take on any desired shape of jewelry, such as a ring, bracelet, or embedded in a watch. Master 10 may also be configured as another item such as a pen, belt, and the like. Master 10 may even be configured as a small transmitter chip that could be embedded within the skin of an individual. The present invention does not limit the specific items which can be configured as the key device.

In operation, when a user attempts to activate slave phone 11, slave transceiver 111 preferably transmits a paging signal from antenna 110. When master 10 is within range, the page signal is received at master transceiver 100. In response to the page signal, code processor 101 preferably formulates a device code for slave phone 11 and transmits the code over master transceiver 100. The transmitted device code is then received by antenna 110 and slave transceiver 111. Code translator 112 preferably deciphers the device code and communicates it to slave controller 113. Based on the device code received, slave controller 113 preferably controls all levels of access to the functionality of slave phone 11 by the user.

In a basic embodiment of the present invention, the device code transmitted from master 10 may simply allow or disallow access to slave phone 11. However, in alternative embodiments, multiple codes may preferably exist which allow slave controller 113 to provide varied levels of access by the user. For example, one device code may allow a user full and unrestricted access to slave phone 11's functionality. Another device code may preferably allow a user only access to slave phone 11's local calling functionality. Thus, any variation of access may be assigned to the user or users based solely on the device code transmitted.

Figure 1B:
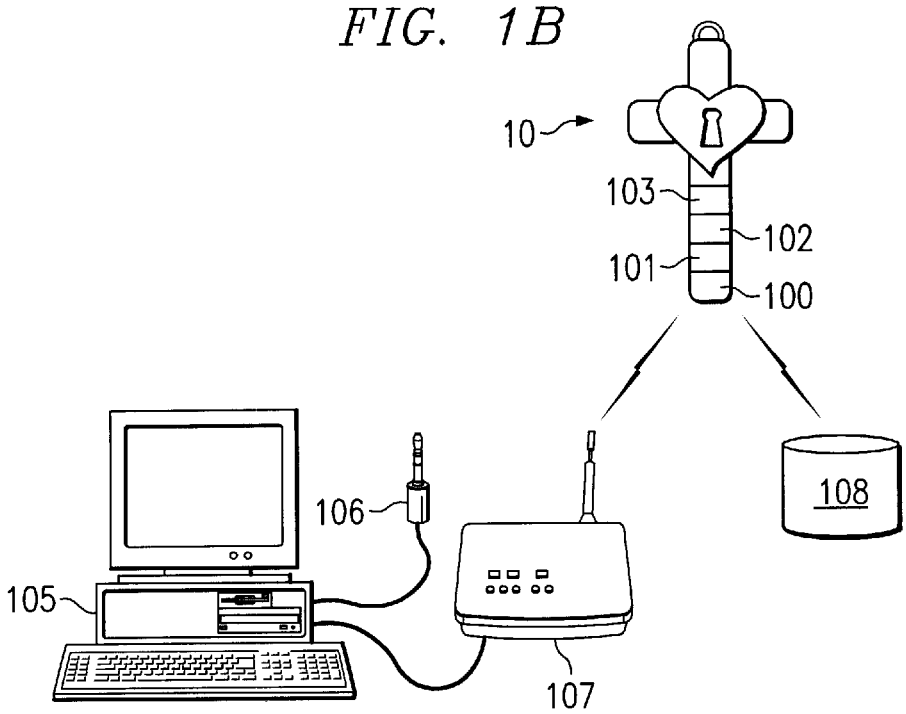
FIG. 1B is a perspective view detailing the master device shown in FIG. 1A.

In the alternative embodiments described implementing varied levels of access, master 10 also preferably includes a programmable base controller for programming different control or access codes. FIG. 1B shows master 10 including programmable base controller (PBC) 102. PBC 102 may preferably comprise a microprocessor or other microcontroller configured to process incoming signals and then control code processor 101 and transceiver 100 to transmit a different device code. PBC 102 may preferably be signaled to change a device code or set of device codes transmitted by master 10. Many different options exist that may be used to signal PBC 102 to change a device code. Master transceiver 100 may preferably include a small connector to accept plug 106 from computer 105. With a direct connection established, PBC 102 may be reprogrammed at computer 105 to transmit a different device code.

It should be noted that PBC 102 would preferably be programmed to process only certain defined frequency signals or ranges of signals. This allows the inventive system to reject, filter, and/or ignore any access codes or paging signals sent from other wireless devices or other implementations of the present invention that are within range.

Alternatively, signal antenna 107 may also be connected to computer 105 and transmit signals to PBC 102 for changing or varying the device codes. A user would then preferably be able to program the desired device codes on computer 105, and then have those codes up-linked to master 10 to change the transmitted device code.

A further alternative, shown in FIG. 1B, includes a separate device, electronic chip 108. Electronic chip 108 may preferably comprise a preset signal that can be received by master 10 which wirelessly signals PBC 102 to change the transmittable device code to a preset value or frequency. In operation, a user may preferably purchase such electronic chip 108 in order to specifically vary or manipulate the device code or codes transmitted by master 10.

In one embodiment of operation, as PBC 102 receives a signal to change the device code, it preferably accesses memory 103 to determine which device code to activate in place of the changed code. Thus, with the combination of memory 103 and the signal from one of the remote devices, master 10 may preferably be customized to a large number of different device codes.

Returning to FIG. 1A, in the event that slave phone 11 is carried outside the transmission range of master 10, access to slave phone 11 is preferably affected. For example, if a thief steals slave phone 11 from the user and attempts to activate it outside the range of master 10, slave phone 11 will preferably not receive the device code and will then preferably not operate to full functionality. It should be noted that various alternative embodiments may be implemented that incorporate different levels of non-authorized access. In some embodiments, slave phone 11 may become totally inoperable, while in other embodiments, slave phone 11 may only have a bare minimum of functionality.

In a further alternative of the present invention, slave phone 11 may preferably be programmed to activate a specific application if it does not receive the appropriate device code from master 10. In one version, slave phone 11 would preferably initiate a communication link with emergency exchange 12. Because the situation may not ordinarily represent a health or fire crisis, emergency exchange 12 would preferably include contact with a security agency or the police. Thus, if a thief has stolen slave phone 11 and thereafter attempts to activate it, the police at emergency exchange 12 would preferably be alerted to the theft.

In a second version, slave phone 11 would preferably initiate a communication link with location exchange 13. Because the situation would likely be similar to that described for the first version, location exchange may preferably include contact with a centralized service that tracks the location of slave phone 11. In further embodiments, both emergency exchange 12 and location exchange 13 are preferably accessed. The dual access would provide any police or security personnel not only with an indication of the theft, but also the location of the thief or other person attempting to use stolen slave phone 11.

Figure 2:
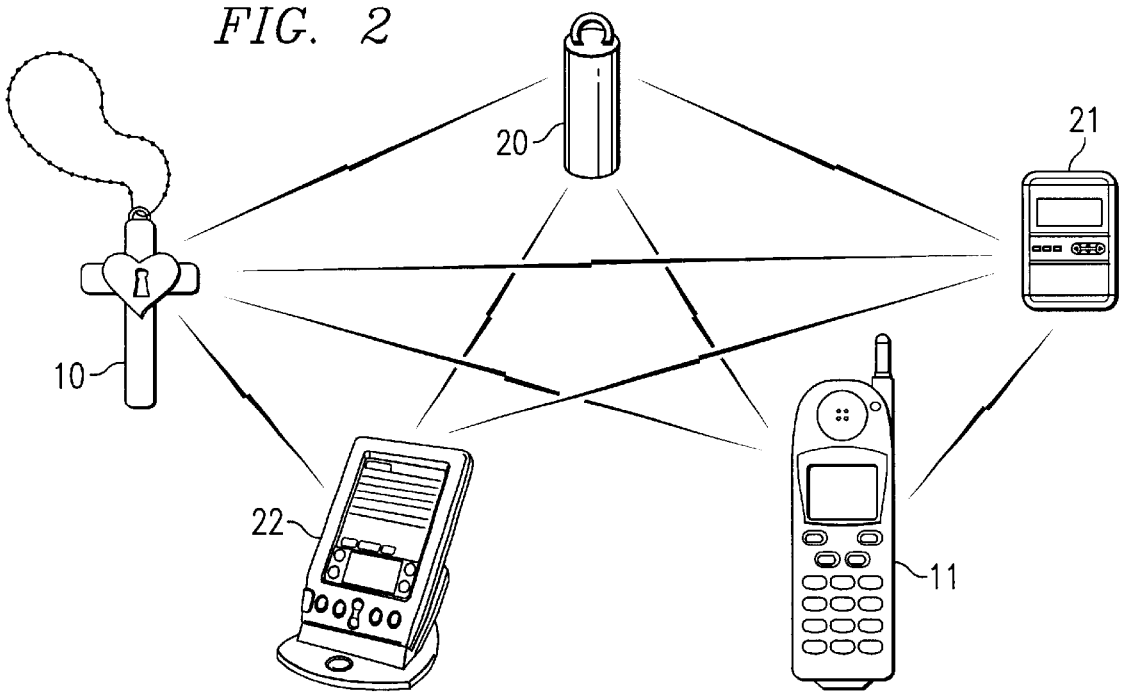
FIG. 2 is a perspective view illustrating an alternative embodiment of the present invention.

FIG. 2 shows the present invention operable with several electronic devices. The user owns and operates slave phone 11, proxy pager 21, and slave PDA 22. However, in order to access the full functionality of these devices, the user must preferably be either wearing master 10 or keeping master 10 in close proximity. As the user attempts to access any of slave phone 11, proxy pager 21, and/or slave PDA 22 the communication systems of those devices must receive an appropriate access code from master 10 in order to properly operate.

It should be noted that some versions of the described alternative embodiment may implement the access code transmission by configuring master 10 as a passive transmission device. In such an embodiment, master 10 is preferably configured into a "listen" mode. On an attempt to access slave phone 11, proxy pager 21, and/or slave PDA 22, the slave devices transmit a page signal. If master 10 is within range to receive the page signal, it responds with the transmission of an access code. The slave devices would then preferably use the access code to control the level of access to the functionality of the device.

In other versions of the described alternative embodiment, master 10 may be configured as a beacon with continuous transmission of the appropriate access code. In such an embodiment, slave phone 11, proxy pager 21, and/or slave PDA 22 are passive devices. Upon activation, the slave devices listen for the access code beacon from master 10. If the code is not received because the device is either outside the range of master 10, or master 10 is not activated, the slave devices would preferably not operate or allow full access to functionality.

An alternative embodiment of the present invention would also preferably incorporate the capability of "loaning" slave devices through use of an alternate master device. Alternate master 20, which is shown as a simple fob with the transmission and processing capabilities of master 10, preferably comprises another transmitter or transceiver, an alternate code processor. However, alternate master 20 can preferably be programmed through a programmable base controller to transmit different access codes for providing differing levels of access to the functionality of the slave device. The user would typically loan or give alternate master 20 to another person. The user would preferably program alternate master 20 to set a specific level of access to the functionality of the slave devices.

Alternate master 20 preferably transmits alternate control signals similar to the access codes transmitted by master 10. Alternate control signals received by slave phone 11, proxy pager 21, and slave PDA 22 preferably allow the slave devices to operate to the specified level programmed by the user. Thus, a person could preferably borrow slave PDA 22 from the user by carrying alternate master 20. As the borrower leaves the transmission range of master 10, the alternate control signals transmitted by alternate master 20 would preferably allow the borrower to access slave PDA 22. For example, the user may preferably program alternate master 20 to provide access only to the calendar and contact list on slave PDA 22. Therefore, the alternate control signals transmitted from alternate master 20 would preferably be translated by the slave device and used to restrict the borrower's access on slave PDA 22 to the calendar function and contact list. If the borrower attempts to access an e-mail or other function of slave PDA 22, it preferably prevents the borrower's access. However, when slave PDA 22 is brought back within the transmission range of master 10, full access to slave PDA 22 would preferably be resumed.

Figure 3:
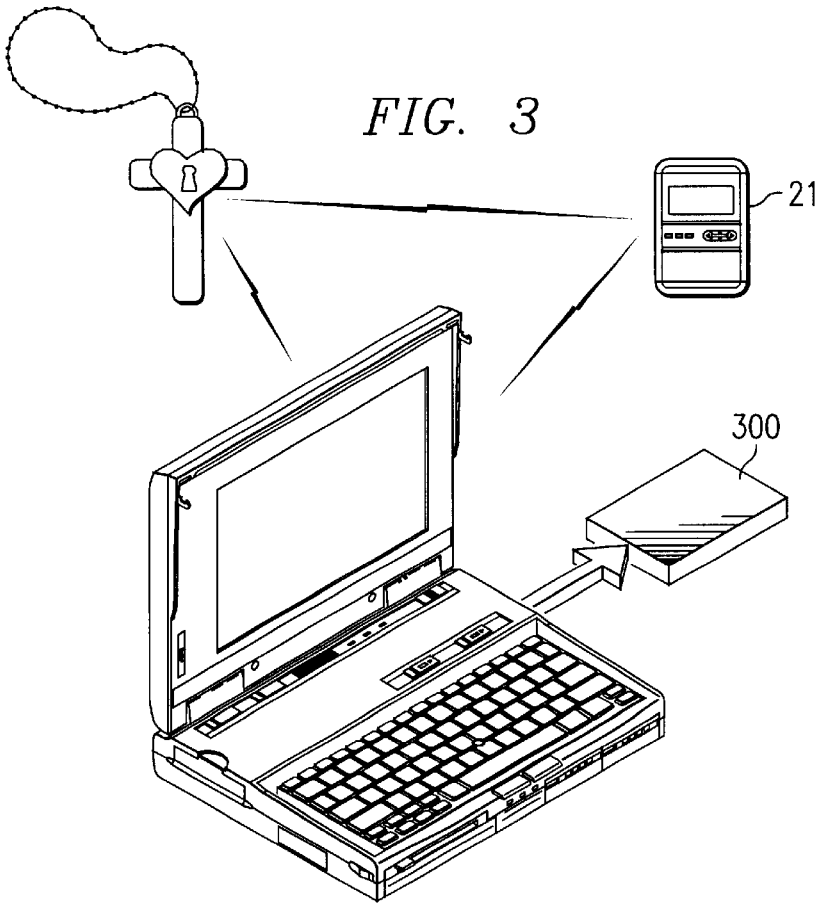
FIG. 3 is a perspective view illustrating a further alternative embodiment of the present invention.

FIG. 3 illustrates an alternative embodiment of the present invention. In addition to allowing persons to borrow the user's slave devices through the use of an alternate master device, the security system also may incorporate proxy devices which preferably simulate the access/device code transmitted by master 10. Proxy pager 21, which is itself a slave device dependent on the access codes from master 10 to operate, preferably allows an increased level of security for a user in case a thief is aware of the proximity security system. Proxy pager 21 preferably comprises another transmitter or transceiver, a proxy code processor, similar to what a master device would have, a proxy controller, similar to what a regular slave device would have, and a proxy timer, for implementing the proxy security measure. A thief, who requires his or her targets to hand over the master device key for the electronic slave devices, may preferably be given proxy pager 21 to minimize the adverse effect of the robbery. Proxy pager 21 preferably transmits full device codes or quasi-access codes (i.e., access codes that are not true access codes as from master 10) to preferably allow full access to any of the slave devices, such as slave laptop 30.

As long as proxy pager 21 is within the transmission range of master 10, it preferably acts as any other slave device, with its access controllably limited by the received control/device codes from master 10. However, once proxy pager 21 exceeds the transmission range of master 10, it preferably begins mimicking the access/device codes originally transmitted by master 10. In this manner, proxy pager 21 will preferably allow anyone full access to slave laptop 30. As a part of the security system, a proxy timer preferably counts for a predetermined amount of time. When the time has expired, proxy pager 21 will preferably cease transmitting the mimicked access codes, thus, immobilizing or severely limiting access to the functionality of slave laptop 30. The predetermined time period would preferably allow the thief to believe he or she had indeed stolen the master device capable of allowing full access to slave laptop 30.

In an alternative embodiment of the present invention, the proximity security system may incorporate additional security applications to activate if a non-owner attempts to access a slave device without the appropriate control signals from a master device. In order to prevent corporate espionage, slave laptop 30 could preferably be programmed to run a security application that erases or re-formats hard drive 300 within slave laptop 30. Thus, if slave laptop 30 has been stolen either without master 10 or with proxy pager 21, hard drive 300 will preferably be erased if the thief attempts to access slave laptop 30 without the appropriate device/control codes. In many such embodiments or versions of such embodiments, it may be preferable to incorporate a failsafe mechanism that warns the user that hard drive 300 will automatically be erased or reformatted if further access is attempted. Thus, if a user accidentally removes slave laptop 30 from the range of master 10, he or she will not automatically lose all information stored on hard drive 300. Similarly, the thief attempting to gather corporate information from stolen slave laptop 30 may abandon any further attempt to access slave laptop 30 and either return or abandon the device.

Figure 4:
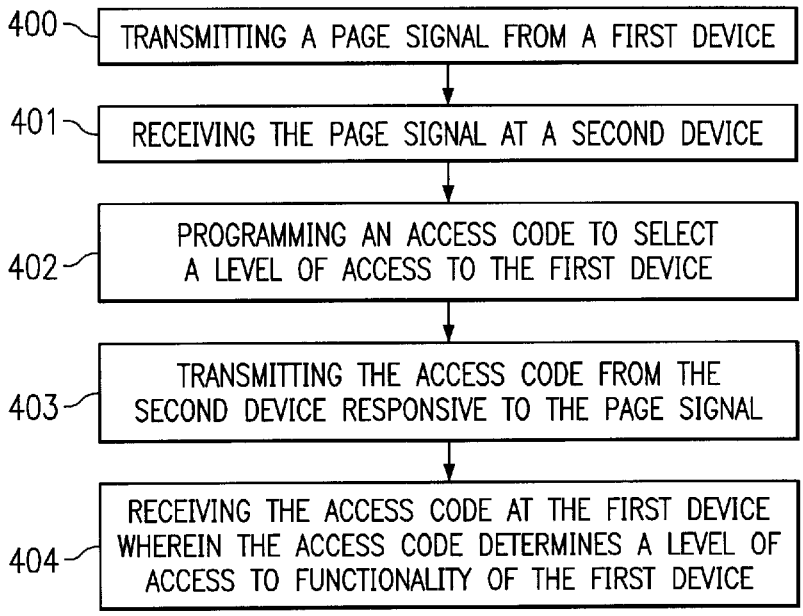
FIG. 4 is a flow chart detailing the steps exercised in implementing a preferred embodiment of the present invention.

FIG. 4 is a flowchart showing the steps typically performed in implementing a preferred embodiment of the present invention. In step 400, a page signal is transmitted from a first device. The page signal is preferably received by a second device in step 401. At some point, a user may program an access code at the second device which will preferably select a level of access to the first device, in step 402. Step 402 does not necessarily have to occur either before or after any of the other steps in FIG. 4. In step 403, the second device transmits the access code responsive to the page signal. The first device receives the access code, wherein the access code determines the level of access to functionality of the first device in step 404.

It should be noted that the present invention is not necessarily used only with typically electronic devices. Other electronic devices that may benefit from other embodiments of the present invention may be incorporated into larger "non-electronic" devices, such as automobiles, airplanes, and the like. In such embodiments the first device might be a starter of the automobile. The second or master device may still be a piece of jewelry as depicted in FIGS. 1–3, or may be a fob or other small device. In operation, a user would only be able to start the engine of the automobile if the master device were in proximity to the starter. Thus, a thief or other unauthorized person would not be able to start the automobile. In the programming of alternate master devices, the car owner could program the alternate master device to limit the maximum speed or range of the automobile. Such an embodiment may be used by parents to limit the speed that their children drive when borrowing the cars, or could also conceivably be used by the court system to limit the range of driving for persons with suspended or limited driver's licenses.

Figure 5:
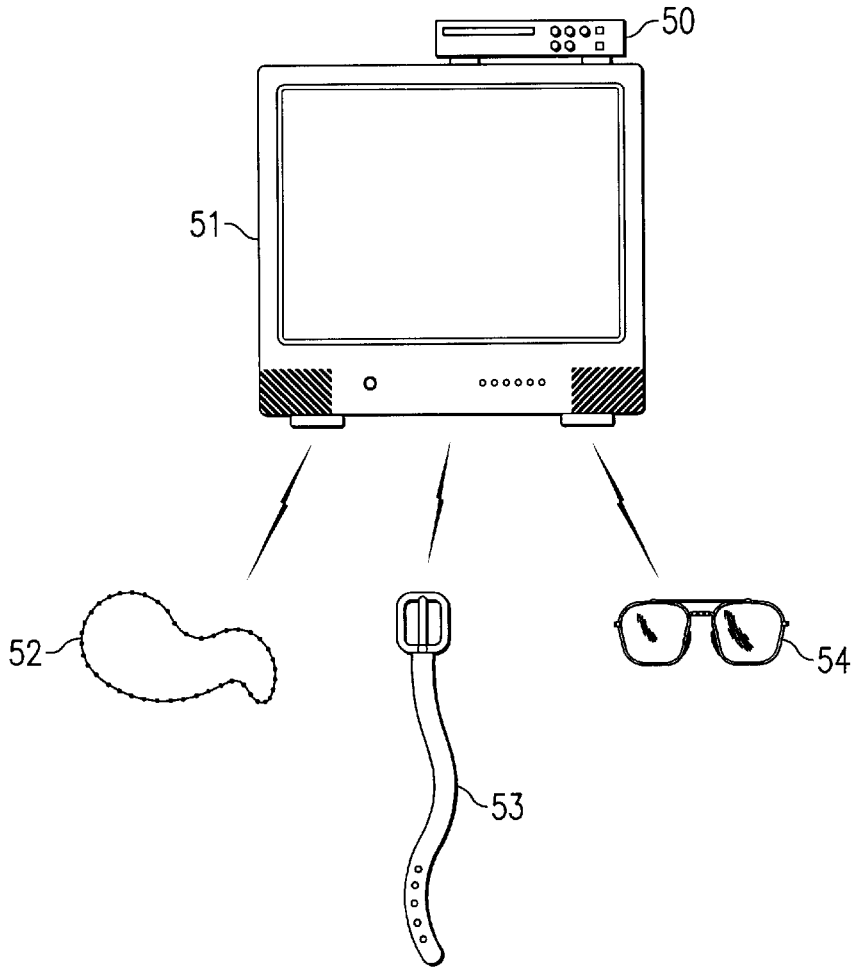
FIG. 5 is a perspective view illustrating another alternative embodiment of the present invention configured to limit access depending on the particular access code.

FIG. 5 illustrates an alternative embodiment of the present invention configured as a feature-limiting system for television viewing. Attempts to monitor and restrict access to adult-oriented material have resulted in the development of parental controls and the V-chip. The alternative embodiment of the present invention may also be configured to restrict access to certain material. In the system depicted in FIG. 5, cable box 50 controls the cable signal to television 51. Cable box 50 preferably restricts the signals to television 51 depending on the specific access code transmitted by either of bracelet 52, belt 53, and eyeglasses 54.

For example, if a child under a certain age wears belt 53, the access code transmitted from belt 53 may be programmed to restrict the child's access to certain television programs, as classified by the industry providers. If the child wearing belt 53 turns on television 51, cable box 50 will not allow cable signals for programs rated above a certain, pre-determine level to be viewed on television 51. The parents or guardians of the child may preferably program the level of access allowed for the child.

If, in the example illustrated by FIG. 5, all of the devices are present in the same room, cable box 50 may be programmed to automatically filter the television signals according to the access signal with the lowest accessibility level or the highest, depending on the wishes of the parent or guardian.

It should furter be noted that the transmission and reception of all access codes, paging signals, or other device or control codes may be implemented in any variety of known wireless protocols. The present invention could be implemented using infrared (IR), Bluetooth™, IEEE 802.11, HomeRF™, or any other number of radio frequency (RF) or wireless protocol technologies.

The present invention may also be implemented using smart card technology. For example, using a smart card, which may be a credit card-sized item, fob, trinket, or the like configured with a built-in microchip, magnetic code, or other similar feature, the user may physically swipe the smart card within a certain pre-determined distance in order to fully activate the electronic device. Similarly, the electronic device may have a specialized receptacle to insert such a smart card to provide activation. In such an insertion configuration, the user would preferably insert the smart card into the receptacle and then remove it to complete the activation.

What is claimed is:

1. An electronic proximal security system comprising:

a master device including:

a first transmitter for communicating at least one device code;

a code processor;

at least one slave device including:

a receiver for communicating said at least one device code;

a code translator;

a slave controller for limiting access to at least one functionality of said slave device responsive to said at least one device code transmitted from said master device; and an alternative master device including:

a second transmitter for communicating said at least one device code; and an alternate code processor; wherein said alternative master device provides alternative control signals for limiting access to functionality of said slave device.

2. The system of claim 1 wherein said master device further includes:

a programmable base controller for programming ones of said at least one device code.

3. The system of claim 1 wherein said master device is programmed to vary said at least one device code for varying access to functionality of said slave device.

4. The system of claim 1 wherein said slave device limits functionality without receiving appropriate said at least one device code.

5. The system of claim 1 wherein said master device communicates said at least one device code responsive to a page code communicated from said slave device.

6. The system of claim 5 wherein said slave device periodically transmits said page.

7. The system of claim 1 wherein said slave device automatically erases a memory disposed within said slave device when a user attempts to access functionality of said slave device without receiving appropriate ones of said at least one device code transmitted by said master device.

8. The system of claim 1 wherein said master device comprises at least one of:

a fob;

a piece of jewelry;

a smart card; and an electronic device.

9. An electronic proximal security system comprising:

a master device including:

a first transmitter for communicating at least one device code;

a code processor;

at least one slave device including:

a receiver for communicating said at least one device code;

a code translator;

a slave controller for limiting access to at least one functionality of said slave device responsive to said at least one device code transmitted from said master device; and a proxy master including:

a third transmitter for communicating said at least one device code;

a proxy code processor for mimicking device codes transmitted by said master device;

a proxy controller for limiting access to functionality of said proxy device responsive to said at least one device code transmitted from said master device; and a proxy timer for continuing operation of said proxy code processor for a predetermined period of time after exceeding a transmission range of said master device.

10. A method for providing proximal security for electronic devices comprising the steps of:

transmitting an access code from a second device responsive to receiving a page signal transmitted from a first device;

receiving said access code at said first device, wherein said access code determines a level of access to functionality of said first device;

programming said access code for selectively controlling said level of access transmitting an alternative access code from a third device, wherein said alternative access code transmitted by said third device is substantially the same as said access code transmitted from said second device; and receiving said alternative access code at said first device, wherein said alternative access code determines said level of access to functionality of said first device.

11. The method of claim 10 further comprising the steps of:

transmitting said page signal from a fourth device;

receiving said access code at said fourth device, wherein said access code determines said level of access to functionality of said fourth device;

transmitting a quasi-access code from said fourth device in response to said received access code, wherein said quasi-access code continues to be transmitted for a preset period of time after failing to receive said access code; and receiving said quasi-access code at said first device, wherein said quasi-access code determines said level of access to functionality of said first device.

12. The method of claim 11 further comprising the step of:

executing an application at said first device responsive to failing to receive at least one of said access code and said quasi-access code.

13. The method of claim 12 wherein said application comprises at least one of:

a communication application for establishing a communication link with a predetermined third party;

a location application for communicating a location of said first device to said predetermined third party; and an alteration application for altering a functional attribute of said first device.

14. The method of claim 10 further comprising the step of:

executing an application at said first device responsive to failing to receive at least one of said access code and said alternative access code.

* * * * *